United States Patent [19]

Miyata et al.

[11] Patent Number: 4,733,132

[45] Date of Patent: Mar. 22, 1988

[54] HIGH ENERGY ACCELERATOR

[75] Inventors: Kenji Miyata; Masatsugu Nishi, both of Katsuta, Japan

[73] Assignee: Hitachi, Ltd., Tokyo, Japan

[21] Appl. No.: 845,347

[22] Filed: Mar. 28, 1986

[30] Foreign Application Priority Data

Mar. 29, 1985 [JP] Japan ..... 60-67183
Jun. 7, 1985 [JP] Japan ..... 60-122785

[51] Int. Cl.[4] ..... H01J 25/10

[52] U.S. Cl. ..... 315/5.41; 315/5.42; 315/3.6

[58] Field of Search ..... 315/5.41, 5.42, 3.5, 315/3.6

[56] References Cited

U.S. PATENT DOCUMENTS 3,171,054 2/1965 Dong et al. ..... 315/3.5
3,205,398 9/1965 Allen et al. ..... 315/5.41 X
3,230,413 1/1966 Chodorow ..... 315/3.5
3,353,121 11/1967 Dube ..... 315/3.5 X
3,906,300 9/1975 Tran ..... 315/5.42
4,066,927 1/1978 Gross ..... 315/3.5
4,155,027 5/1979 Schriber et al. ..... 315/5.42
4,160,189 7/1979 Tran et al. ..... 315/5.42

*Primary Examiner*—Saxfield Chatmon
*Attorney, Agent, or Firm*—Antonelli, Terry & Wands

[57] ABSTRACT

In an accelerator for accelerating charged particles by using electro-magnetic wave, in which a plurality of cells are disposed periodically, a washer-shaped electrode separated from the cylinder wall is located at the boundary of each of the cells, which electrode has a hole, through which accelerated charged particles pass, at its center portion and an approximately uniform thickness. The thickness and the diameter of said washer-shaped electrode and the gap between said washer-shaped electrode and the inner surface of said cylinder are so chosen that the average strength of the accelerating electric field is highest. The peak strengths of the electric field are approximately equal at the outer and inner peripheral portions of said washer-shaped electrode.

6 Claims, 27 Drawing Figures

FIG. 1
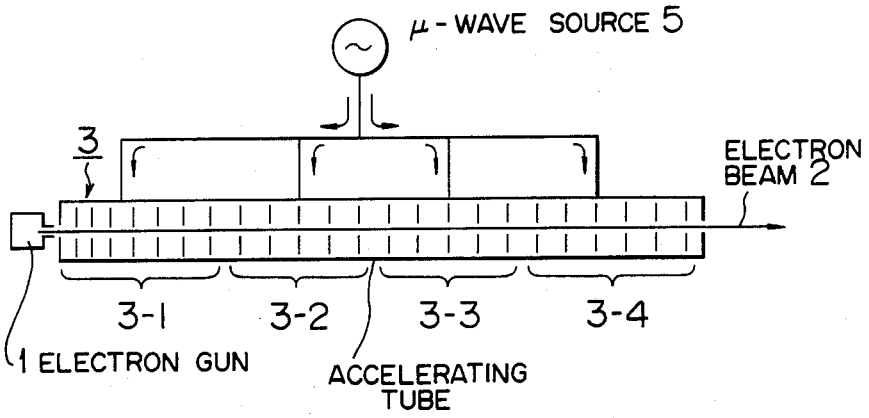
FIG. 2A
FIG. 2B
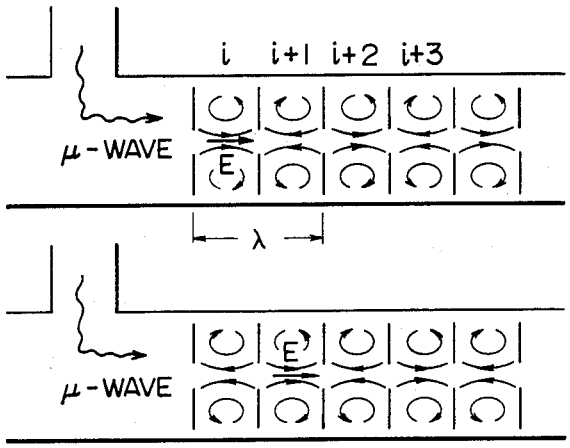

HIGH ENERGY ACCELERATOR

BACKGROUND OF THE INVENTION

1. FIELD OF THE INVENTION

This invention relates to a high energy accelerator and in particular to an accelerator, which accelerates charged particles by using electro-magnetic waves of high frequencies.

2. DESCRIPTION OF THE RELATED ART

As charged particle accelerators, linear accelerators, loop-shaped storage rings, etc. are known. In these accelerators a high frequency electric field (electromagnetic wave) is used for accelerating charged particles to an extremely high energy.

When microwave energy is made to pass through a simple cylindrical structure, the phase velocity of the microwave exceeds the velocity of light. It is a matter of course that the energy propagation velocity (group velocity) cannot exceed the velocity of light. Therefore, in order to accelerate charged particles in the neighborhood of the velocity of light, the structure of an acceleration tube is so designed that the phase velocity of the microwave propagating therein is caused to be lower than the velocity of light, so that the phase velocity and the velocity of the charged particles are equal. More specifically, a structure varying periodically along the axis of the acceleration tube is adopted so that there exists a certain dispersion relation based on the periodicity between the energy and the wave number vector.

Hereinbelow, unless otherwise specified, as an example, a linear accelerator for accelerating electrons will be explained. The prior art structure of the linear accelerator is described e.g. in IEEE Trans. Nuclear Science, NS-28, No. 3, P. 2873, p3440, June 1981.

Now, as the first index representing characteristics of a linear accelerator Em/Ep is used, in which Ep represents the possible maximum field strength, which can be considered to be a constant, the upper limit of which is determined by discharge inside of the acceleration tube. Consequently, in order to increase the spatially averaged electric field Em for accelerating charged particles, a structure, in which Em/Ep is great, i.e. as close as possible to 1, is preferable. When Em is also averaged with respect to time, the maximum value of the ratio $\mu$ becomes $1/\sqrt{2}$ . When the accelerating electric field Em is restricted to a small value, a longer acceleration tube is necessary for accelerating charged particles to a certain energy and according to circumstances the acceleration tube would be so long that it is difficult to realize it.

As the second index representing characteristics of the linear accelerator, $v_g/C$ is used. When charged particles are accelerated, energy of the microwave supplied to the acceleration tube is consumed by particles to be accelerated. Consequently, in order to continue the acceleration of the particles, it is necessary to supply smoothly energy of the microwave. For this purpose it is required that the energy propagation velocity (group velocity of the microwave) $v_g$ is great. Since the velocity cannot exceed the velocity of light C, a dimensionless parameter $v_g/C$ is used for analyzing characteristics of a linear accelerator, adopting the velocity of light C as a reference value. Then it is desirable that $v_g/C$ is as close as possible to 1. In order to be able to accelerate particles in the neighborhood of the velocity of light a simple periodic construction is insufficient and a combination of a plurality of periodic structures is efficacious.

It is, for example, a composite periodic structure including disks on the inner surface of the cylinder wall and washers separated from the inner surface of the cylinder wall.

As the third index representing characteristics of the linear accelerator the effective shunt impedance R is used. This is a measure for the acceleration efficiency, indicating with what efficiency injected energy of the microwave contributes to the acceleration of the particles, and a greater R can be interpreted to be a higher acceleration efficiency.

The effective shunt impedance per unit length can be defined as follows;

$$R = \frac{\left| \int_0^L E_0(Z) e^{jkZ} dZ \right|^2}{PL}$$

$$k = \frac{2\pi}{\beta\lambda},$$

$$\beta = \frac{v}{C},$$

where

L: length of a period of the acceleration tube, $E_0(Z)$: strength of the electric field on the axis of the beam, P: energy loss due to wall current for the length of a period, $\lambda$: guide wavelength of the microwave, and v: velocity of particles.

That is, in order to increase the effective shunt impedance, it is efficacious to increase the axial component of the electric field vector on the axis and to reduce the energy loss P due to wall current.

If simply disks protruding from the inner surface of the acceleration tube towards the axis are disposed, the shunt impedance is small and thus the acceleration efficiency is low.

Accordingly it has been proposed to use thin washers separated from the inner surface of the acceleration tube in order to reduce the wall current and to dispose projections in the axial direction in the central aperture portion of the washers in order to strengthen the electric field on the axis. However, if importance is attached only to strengthening the electric field on the axis, the electric field is reduced as a whole in the acceleration tube. Consequently the length of the acceleration tube for accelerating particles to a predetermined energy is increased to such an extent that it is unattainable.

SUMMARY OF THE INVENTION

An object of this invention is to provide a high electric field type accelerator having excellent acceleration characteristics.

Another object of this invention is to provide an accelerator which makes it possible to obtain a high acceleration energy with a short acceleration tube.

According to one aspect of this invention, an accelerator is proposed, for which various parameters of the acceleration tube including washer electrodes are so chosen that the average accelerating electric field in the acceleration tube is increased.

According to another aspect of this invention, an acceleration tube having washer electrodes is proposed, for which various parameters of the washer electrodes are so chosen that the peak of the strength of the electric field at the central aperture of the washer electrodes is approximately equal to that at their peripheral portion.

BRIEF DESCRIPTION OF THE DRAWINGS

FIG. 1 is a diagram showing schematically the construction of a microwave acceleration linear accelerator;

FIGS. 2A and 2B are diagrams for explaining the fundamental working mode of a microwave acceleration linear accelerator;

DETAILED DESCRIPTION OF THE INVENTION

Figure 3A:
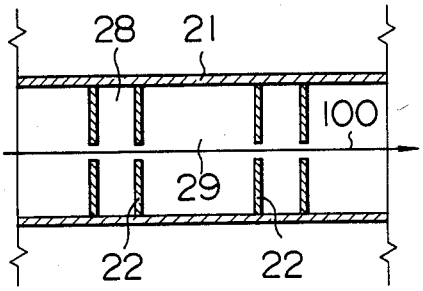
FIG. 3A PRIOR ART
FIGS. 3A and 4A are cross-sectional views along the axial direction illustrating 2 examples of prior art linear accelerators.

FIG. 1 shows schematically the whole construction of an accelerator. An electron beam 2 emitted by an electron gun 1 is introduced in an acceleration tube 3. The acceleration tube 3 is divided into several portions 3-1, 3-2, 3-3, 3-4, to each of which microwave energy is supplied by a microwave source 5. In each of the portions of the accelerator a cell structure is formed so that electrons are accelerated by the microwave energy with a high efficiency. Since the velocity of electrons is still low just after having been emitted by the electron gun 1, in the first portion 3-1 of the acceleration tube the distance between cells is short at first and becomes longer and longer. Electrons are accelerated there almost to the velocity of light and supplied to the succeeding portions 3-2, 3-3, 3-4. Since the velocity of electrons (or other charged particles) doesn't increase appreciably thereafter by an relativistic effect, although their mass is increased by the acceleration, it can be considered as substantially a constant. Thus, the cells in the succeeding portions 3-2, 3-3, 3-4 are arranged almost periodically.

The fundamental principle of the working mode of such an accelerator will be explained below, referring to FIGS. 2A and 2B. There are two acceleration modes using microwave energy, i.e. a travelling wave type and a standing wave type, but for convenience' sake only a standing wave type accelerator will be explained below. FIGS. 2A and 2B illustrate schematically electric fields in the acceleration tube, which are in anti-phase to each other. In the figure, 2 cells adjacent to each other form a period (1 wavelength). The unit period of the accelerator, however, is formed of one cell. Now, in the state indicated in FIG. 2A, positively charged particles in the i-th cell are subjected to an electric field to the right. By this fact, when the particles proceed to the (i+1)-th cell, the electric field is reversed to the state indicated in FIG. 2B and thus they are subjected further to the electric field to the right. When the particles proceed to the (i+2)-th cell, the electric field is again reversed to the state indicated in FIG. 2A and thus they are subjected still further to the electric field to the right. In this way the charged particles are successively accelerated by the periodic electric field to a high energy state. It would be obvious that charged particles can be accelerated in a desired direction regardless of the sign of the charge, when the phase of the microwave is regulated so as to be matched therewith.

In order that this invention can be understood better, typical acceleration tubes according to prior art techniques will be explained briefly.

Figure 3B:
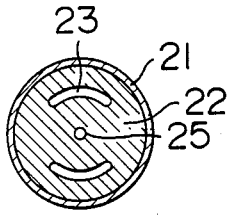
FIG. 3B PRIOR ART
FIGS. 3B and 4B are cross-sectional views along the radial direction through an electrode of the construction indicated in FIGS. 3A and 4A, respectively.
Figure 4A:
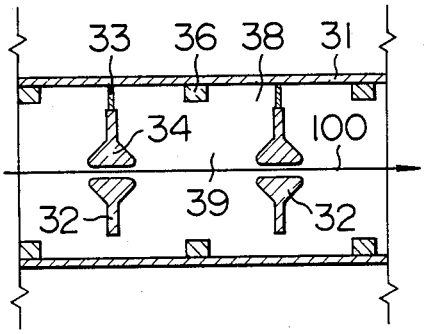
FIG. 4A PRIOR ART
Figure 4B:
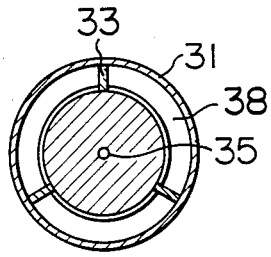
FIG. 4B PRIOR ART

Taking the case where charged particles are electrons as an example, the outlined construction of two prior art acceleration tubes is illustrated in FIGS. 3A, 3B and FIGS. 4A, 4B. FIGS. 3A and 4A are cross-sectional views in the axial direction of the acceleration tubes and FIGS. 3B and 4B are their cross-sectional views in the radial direction.

Each cell (cavity) is defined by two disks 22 in FIG. 3A and by a washer 32 and a disk 36 in FIG. 4A. Further, in the construction indicated in FIGS. 3A and 3B, in order to improve the coupling of modes of electromagnetic wave between adjacent cells so that energy of the electro-magnetic wave (microwave) flows smoothly, arc-shaped holes 23 are disposed around the center axis of the disks.

Figure 5A:
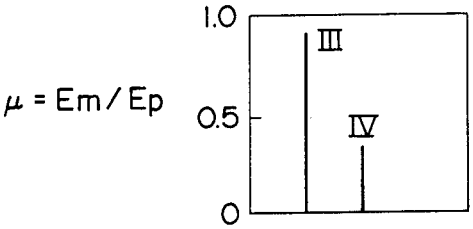
FIGS. 5A, 5B and 5C are graphs comparing the prior art accelerators illustrated in FIGS. 3A, 3B and FIGS. 4A, 4B.
Figure 5B:
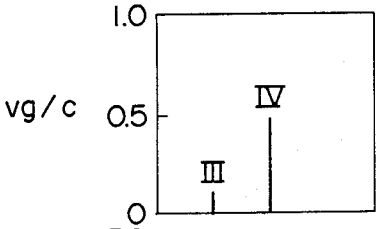
Figure 5C:
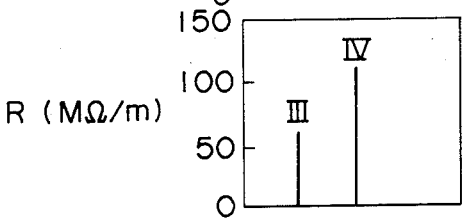

Characteristics of the acceleration tube in these constructions are indicated in FIGS. 5A, 5B and 5C, where Em represents the strongest electric field on the center axis of the acceleration tube, i.e. on the axis of the beam; Ep the strongest electric field in the whole construction of the acceleration tube; $v_g$ the energy propagation velocity of the microwave; and C the velocity of light. In addition, R indicates the effective shunt impedance. Further the sign III means that the data relates to the case indicated in FIGS. 3A and 3B and the sign IV means that the data relates to the case indicated in FIGS. 4A and 4B. In the case indicated in FIGS. 3A and 3B the energy propagation velocity $v_g/C$ is too low and it cannot be said that the shunt impedance is high. On the other hand, in the case indicated in FIGS. 4A and 4B, these drawbacks are removed, but there is another problematical point that a very long acceleration tube is necessary for obtaining high energy particles, because Em/Ep is low and no strong electric field can be applied thereto.

According to an analysis of the inventors of this invention the prior art structure indicated in FIGS. 4A and 4B will be considered below more in detail. In this structure it is regarded as important to enlarge the effective shunt impedance per unit length R and to increase the acceleration efficiency. At first the electrodes delimiting unit cells are separated from the wall 31 of the acceleration tube to form washer-shaped electrodes 32 so that the current flowing between the electrodes and the wall consists principally of displacement current. By this fact wall current loss is reduced. Furthermore, in order to strengthen the electric field on the axis, nose cones 34 are disposed on each of the washer-shaped electrodes 32. By the protrusions formed by the nose cones 34 the electric field is concentrated on the axis, which increases the value of $E_0(Z)$ and raises the effective shunt impedance per unit length R.

However, it is not advantageous from the point of view of increasing $\mu = Em/Ep$ to try to concentrate the electric field only on the axis of the acceleration tube. The value of $\mu$ is indeed remarkably reduced in the structure indicated in FIGS. 4A, 4B.

The inventors of this invention have removed the nose cones from the structure indicated in FIGS. 4A and 4B on trial. Concentration of the electric field should be remarkably alleviated, but the decrease of the effective shunt impedance R was about only 30%. It can be supposed that this is due to the effect that the washer-shaped electrodes are separated from the cylinder, which reduces the wall current loss.

Figure 6A:
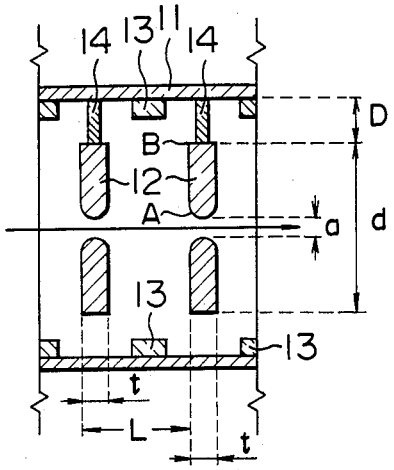
FIGS. 6A and 6B are an axial and a radial cross-sectional view, respectively, of an accelerator according to an embodiment of this invention.
Figure 6B:
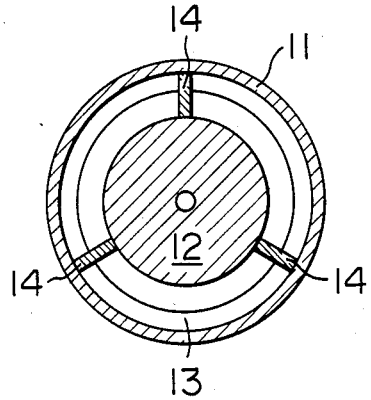

FIGS. 6A and 6B illustrate the fundamental structure according to the invention. Washer-shaped electrodes 12 and disks 13 are arranged periodically in the axial direction in a cylinder 11. The dimensions of the disks 13 are selected to modulate the periodicity in the acceleration tube so as to be able to accelerate charged particles and regulate dispersion characterstics of the acceleration tube so that the phase velocity of the microwave is nearly equal to the velocity of light. No axial protrusions such as nose cones are disposed on the washer-shaped electrodes 12 and thus concentration of the electric field in the tube is alleviated. This structure differs from the prior art structure indicated in FIGS. 4A and 4B essentially at the following points. In this structure the washer-shaped electrodes 12 have no protrusions such as nose cones 34 disposed in the prior art structure, but they are flat. In addition, in the prior art structure, the thickness t in the axial direction of each of the washer-shaped electrodes is as small as possible. To the contrary, in this structure the thickness t has a certain value so that the value of $\mu$ as one of the characteristics of the high electric field of an acceleration cavity is largest.

The technical conception that the thickness of the washer-shaped electrodes is so chosen that the value of $\mu$ is largest will be explained, referring to data. Here an electron accelerator is taken as an example, in which the frequency of the microwave was 2856 MHz and the cylinder 11 and the washer-shaped electrodes 12 were made of oxygen free copper, which is a good electric conductor (volume resistivity: $1.7\times10^{-8}$ Ω·m). The inner diameter of the cylinder 11 was 140 mm and the outer diameter of the washer-shaped electrodes 12 was 80 mm. Three sorts of washer-shaped electrodes 12, for which the diameters a of the holes, through which the electron beam passed, were 8 mm, 16 mm and 24 mm, were used. Under these conditions variations of the value of $\mu$ and those of the effective shunt impedance per unit length R were measured, while varying the thickness t in the axial direction of the washer-shaped electrodes 12. The results thus obtained are indicated in FIGS. 7A and 7B.

Figure 7A:
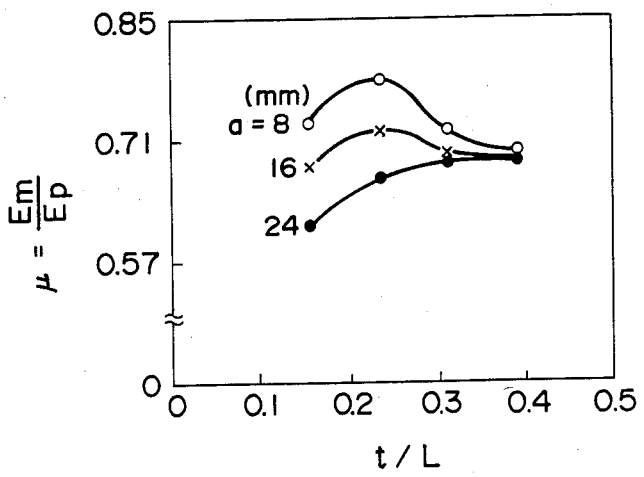
FIGS. 7A and 7B are graphs showing the electric field distribution and the shunt impedance, respectively, of the embodiment indicated in FIGS. 6A and 6B.

In FIG. 7A, in the case where the central bore is not too large, a=8, 16, the value of $\mu$ is largest at the neighborhood of t/L=0.20–0.25. This fact can be explained from the concrete phenomenological point of view, as follows. In the structure indicated in FIGS. 6A, 6B, the strength of the electric field at the wall surface of a washer-shaped electrode 12 has maximums at two points A and B. The relation in the magnitude of the strength of the electric field at these two points is reversed at the neighborhood of t/L=0.20–0.25. That is, when t/L is greater than this value, the electric field at the point A is stronger than that at the point B and to the contrary, when t/L is smaller than this value, the electric field at the point B is stronger than that at the point A. In this example, when t/L=0.20–0.25, the largest value of $\mu$ is obtained. This means that $\mu$ is larger, when the electric field is not concentrated in any part of the acceleration tube, but the electric field is as uniform as possible. That is, when the electric field has maximums at the points A and B, it is desirable that E(A)=E(B).

Further, as parameters determining the distribution of the electric field in the acceleration tube, apart from the thickness t of the washer-shaped electrodes, there are the outer diameter d of the washer-shaped electrodes, the diameter a of the hole in each of the washer-shaped electrodes, and the gap D between the washer-shaped electrodes and the inner surface of the cylinder. Since, among them, the diameter a of the hole is mostly determined by the specification of the accelerator, it is preferable to choose remaining t, d and D so that $\mu$ is largest. Also, when the diameter of the accelerator tube, d+2D, is given, the range of selection is further limited.

Figure 7B:
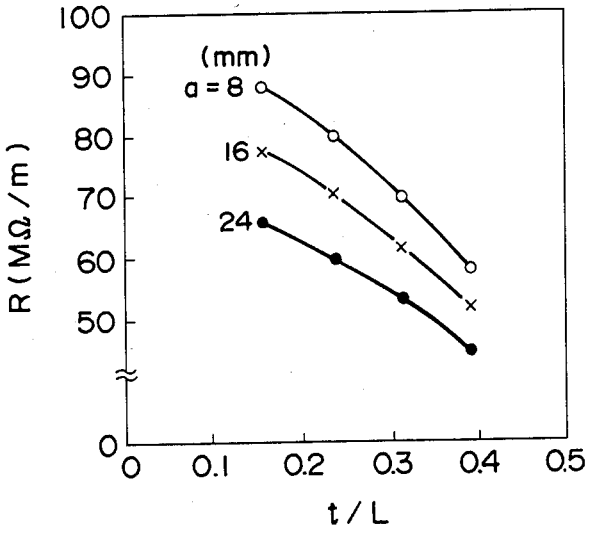

Moreover, as it can be seen from FIG. 7B, the effective shunt impedance per unit length R decreases monotonically with increasing t/L. However, when the acceleration tube has been so regulated that the largest $\mu$ is obtained, the decrease of the shunt impedance per unit length R has been only about 10% with respect to its peak value. The effective shunt impedance per unit length R has decreased by about 30% with respect to that obtained by the prior art structure, but it has been possible to increase $\mu$ to a value about 3 times as large as that of the prior art structure.

A high energy accelerator must be cooled. In the structure indicated in FIGS. 4A and 4B, cooling of the washer-shaped electrodes poses a problem, because they are thin. The washer-shaped electrodes having a certain thickness according to this invention are advantageous also for cooling, such as for the installation of water-cooling pipes, etc.

Figure 8A:
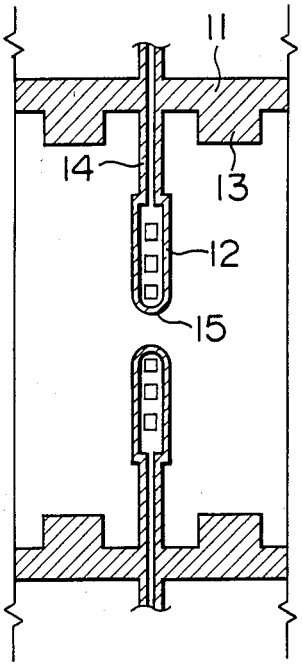
FIGS. 8A and 8B are an axial and a radial cross-sectional view, respectively, of an accelerator according to another embodiment of this invention.
Figure 8B:
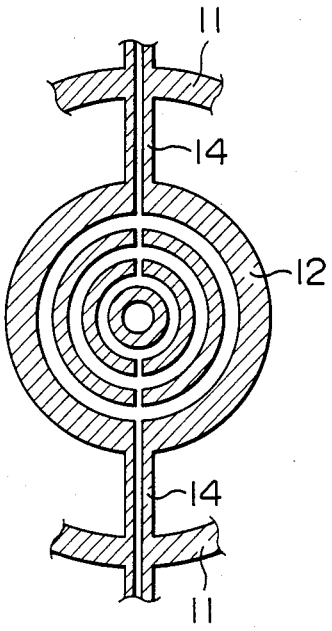

FIGS. 8A and 8B show an example of washer-shaped electrodes having a cooling pipe. Each of the washer-shaped electrodes 12 is secured through stems 14 within the cylinder 11. A cooling pipe arranged within the washer-shaped electrode prevents heating of it due to collisions of high energy particles therewith. This structure enables effective cooling and enhances the operation of the accelerator.

In the embodiment described above, washer-shaped electrodes and disks were used in order to obtain a phase velocity of the microwave energy in the neighborhood of the velocity of light. In addition the thickness of the washer-shaped electrodes was varied. This was for the purpose of modulating the periodicity and regulating the dispersion relation. However, when the washer-shaped electrodes are arranged according to the fundamental periodic construction, the periodicity can be varied also by constructions other than the disks.

Figure 9A:
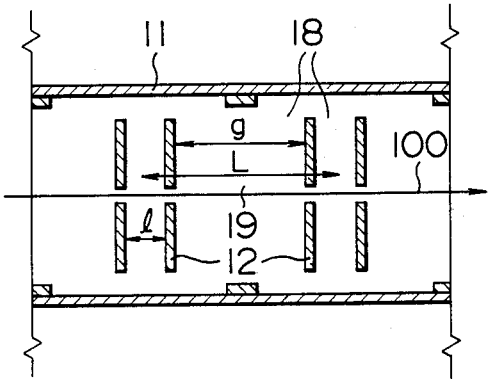
FIGS. 9A and 9B are a longitudinal and a transverse cross-sectional view, respectively, of an accelerator according to still another embodiment of this invention.
Figure 9B:
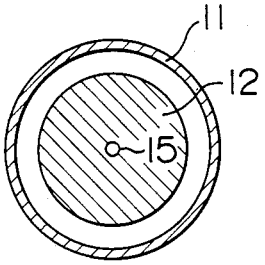

FIGS. 9A and 9B indicate a structure, in which each cell has 2 washer-shaped electrodes. This structure can be understood as one in which a washer-shaped electrode having a certain thickness in the structure indicated in FIGS. 6A and 6B is divided into 2 thin washer-shaped electrodes. In a cylinder 11 are disposed periodically pairs of coaxial washers having a distance l with the length of a period L and at the central portion of each of the washers 12 is formed a hole 15, through which charged particles pass. However, in the figures, the portion coupling the washers 12 with the cylinder is omitted. This structure is analogous to the periodic structure using pairs of disks 22 indicated in FIG. 3A, but the former differs essentially from the latter at the following points. That is, in the structure indicated in FIG. 3A, the coupling cavity 28 is on the same axis as that of the acceleration cavity 29 and the former is never on the periphery of the latter. To the contrary, in the structure according to this invention indicated in FIGS. 9A and 9B, the coupling cavity 18 extends also over the periphery of the acceleration cavity 19. Put g for the distance between the washers at both the extremities of one cell and L for the length of one cell. When the ratio of g to L, i.e. g/L is varied from 0.5 to 1, also the ratio of the strength of the electric field at the gap between the pheriphery of the washer and the inner surface of the cylinder to that at the neighborhood of the hole in the center portion of the washer, through which accelerated particles pass, varies considerably. Here, in the case where g/L decreases, if each of the electrodes delimiting the acceleration cavity were constituted only by one washer, the electrode itself would be too thick. To the contrary, in the case where g/L is regulated by means of two washers, the acceleration tube is so constructed that each cell is delimited by pairs of two relatively thin washers.

Figure 10:
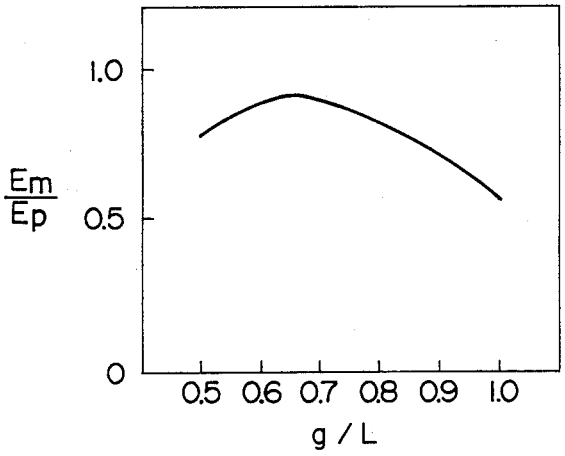
FIG. 10 is a graph showing variations of the electric field strength ratio Em/Ep with respect to the ratio g/L of the distance between washer electrodes g to the length of a unit cell L for the embodiment indicated in FIGS. 9A and 9B.

FIG. 10 shows variations of Em/Ep, when g/L varies from 0.5 to 1. Here, the reason why g/L smaller than 0.5 is not considered is that Em/Ep for $g/L<0.5$ and the same for $g/L>0.5$ are identical, except that they are shifted from each other by a half period. As can be seen from FIG. 10, Em/Ep is largest around $g/L=0.60$–$0.70$, especially around 0.65.

The essential point of this invention consists in the structure of the washer-shaped electrodes 12 themselves and the relation in arrangement between the electrodes and the cylinder 11. However, the structure of the stems 13 securing the washer-shaped electrodes 12 to the cylinder 11 also has various influences on the characteristics of the accelerator. Hereinbelow the structure of the stems will be described.

Figure 11A:
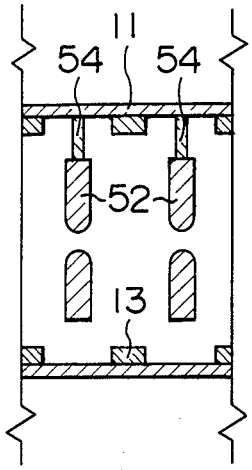
FIGS. 11A and 11B are cross-sectional views in the axial and the radial directions, respectively, illustrating a first variation of the stems.
Figure 11B:
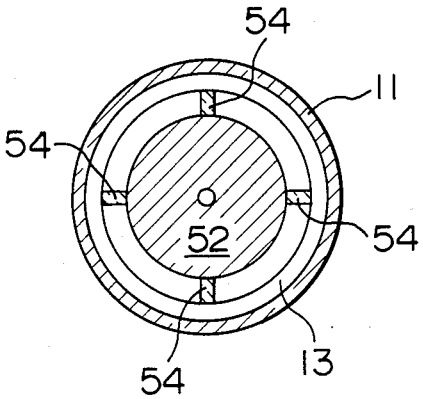

FIGS. 11A and 11B show an example of the structure of the stems. In this example, the stems 54 supporting the washer-shaped electrodes 52 are arranged asymmetrically around the axis. This asymmetry has an effect to suppress high order modes around the axis having bad influences on the acceleration of the beam. In this example, two stems 54 are disposed for one washer-shaped electrode 52 so that they form an angle of 90°. However the angle formed by these two stems 54 can be an arbitrary angle other than 90° and 180°. Further the number of the stems is not limited to 2, but it can be one, three or four. However it is desirable that it is as small as possible, in order not to disturb the distribution of the electro-magnetic field accelerating charged particles. In addition, attention should be paid that the vector obtained by integrating the accelerating electric field in the neighborhood of the beam axis along its axis is directed on the average in the axial direction. This means that the structure of the whole accelerator should be synmetric on the average with respect to its axis. Taking this fact into account, in the example indicated in FIGS. 11A and 11B, the two stems 54 of different washer-shaped electrodes are so disposed that they are located at positions, which are periodically opposite to each other.

Figure 12A:
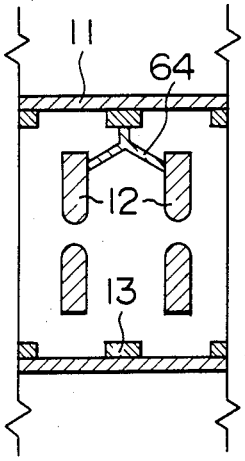
FIGS. 12A and 12B are cross-sectional views in the axial and the radial directions, respectively, illustrating a second variation of the stems.
Figure 12B:
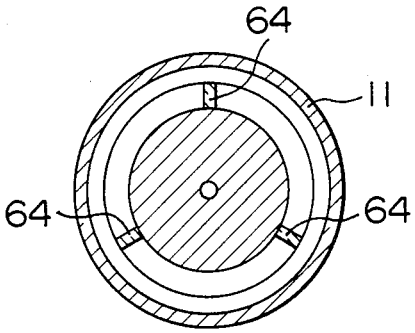
Figure 13:
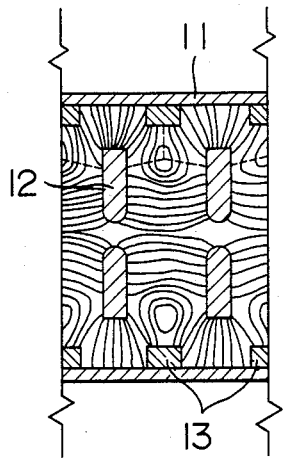
FIG. 13 shows the distribution of the lines of electric force in an acceleration tube according to this invention.

FIGS. 12A and 12B show a second variation. This example is characterized in the structure of the stems 64. It is preferable to dispose the stems so that they disturb the distribution of the electro-magnetic field as slightly as possible. FIG. 13 shows the distribution of the lines of electric force in an acceleration tube, in which there are no stems. The broken line in FIG. 13 indicates the position of the stems 64 illustrated in FIGS. 12A and 12B. As it can be seen from FIG. 13, the stems are approximately perpendicular to the direction of the electric field so that the disturbance of the distribution of the electric field due to the existence thereof is minimum. In FIGS. 12A and 12B three stems 64 are arranged with a same interval around the axis. However, they can have the same effect as that obtained by the preceding embodiment indicated in FIGS. 11A and 11B, when they are distributed with different intervals around the axis or further when the number of stems 64 is changed.

Figure 14A:
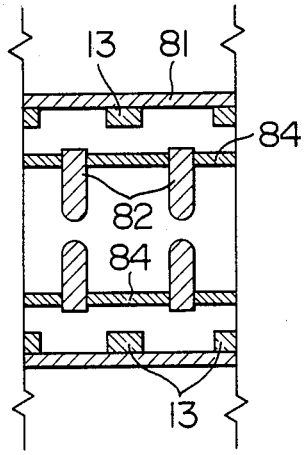
FIGS. 14A and 14B are cross-sectional views in the axial and the radial directions, respectively, illustrating a third variation of the stems.
Figure 14B:
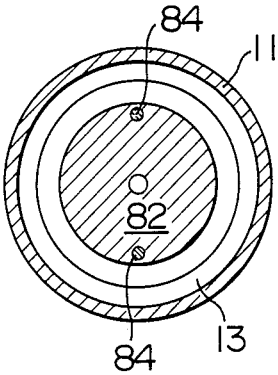

FIGS. 14A and 14B show a third variation. In this variation the stems 84 are not in the radial direction, but in the axial direction. In this structure there are no radial supports, but the stems 84 supporting washer-shaped electrodes 82 are secured only on both the axial ends of the cylinder 81. Consequently, this structure has an advantage that fabrication of the acceleration tube is remarkably facilitated.

Further, in general, a cooling pipe for cooling both the washer-shaped electrodes and a stem passes through the stem. In this structure the number of inlets and outlets of cooling water pipes seen from the outside of the acceleration tube is reduced, which simplifies the construction of the whole accelerator tube and contributes to the lowering of the fabrication cost. This structure has also another advantage that by the maintenance of the acceleration tube the washer-shaped electrodes 82 can be easily dismounted.

Figure 15:
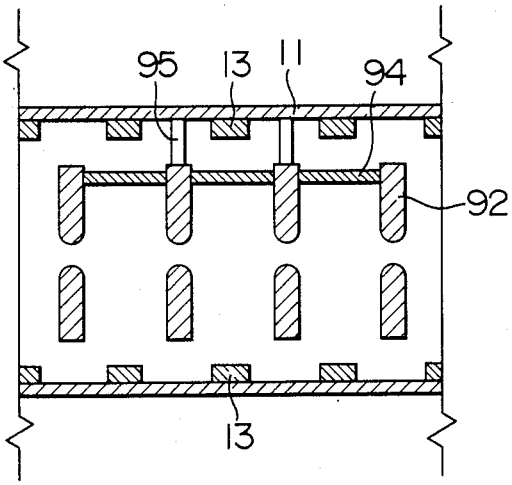
FIG. 15 is a cross-sectional view in the axial direction illustrating a fourth variation of the stems.

FIG. 15 shows a fourth variation. In this structure one set of washer-shaped electrodes 92 connected by means of an axial stem 94 is supported by commcn radial stems 95. When an acceleration tube is very long, by the structure indicated in FIGS. 14A, 14B, the stems 84 should be thick for maintaining the rigidity of the stems 84 and consequently the loss of the microwave energy increases. In order to remove this drawback, the structure of the stems indicated in FIG. 15 has been conceived, in which the washer-shaped electrodes are divided into several sets and each set of electrodes is supported together by common stems. That is, this structure may be described as a cross between that indicated in FIGS. 11A, 11B and that indicated in FIGS. 14A, 14B. This structure can have also the effect, which is characteristic of the embodiment indicated in FIGS. 11A, 11B, when the radial stems 95 are arranged asymmetrically in the pheripheral direction, as indicated in FIG. 11A, 11B.

Although according to this invention it is possible to obtain a high average strength of the electric field accelerating charged particles, the effective shunt impedance per unit length, which is a measure for the efficiency of the acceleration, is somewhat lower than that obtained by the prior art techniques indicated in FIGS. 4A, 4B. However, when the acceleration tube is constructed by using superconductive cavities, this effective shunt impedance can be increased incommensurably. It is thought that according to the present superconductivity techniques the average strength of the electric field accelerating charged particles can be increased at highest up to 30 MV/m because of the instability due to destruction of the superconductive state by the strong magnetic field of the microwave. If the critical magnetic field defining superconductive characteristics can be increased to a value more than four times as high as the present value, it is possible to construct a superconductive acceleration tube having an average strength of the accelerating electric field greater than 100 MV/m. If this is realized, it is possible to obtain, according to this invention, an acceleration efficiency thoroughly comparable with that obtained by the prior art techniques indicated in FIGS. 4A, 4B and thus an acceleration tube excellent both in acceleration efficiency and in strength of the accelerating electric field.

What is claimed is:

1. An accelerator having a periodic structure for accelerating charged particles by means of high frequency electro-magnetic wave comprising:

a hollow acceleration tube extending in one direction; and washer-shaped electrode means including a plurality of washer-shaped electrodes disposed within and separated from said acceleration tube, each of said washer-shaped electrodes having substantially uniform thickness, the sizes of said acceleration tube and said washer-shaped electrodes being such that the strength peak of the electric field is approximately equal at the inner portion and at the peripheral portion of said washer-shaped electrodes.

2. An accelerator according to claim 1, in which said washer-shaped electrodes have a hollow portion through which cooling medium is made to pass.

3. An accelerator according to claim 1, in which said washer-shaped electrode means consists of two washer-shaped electrodes per cell.

4. An accelerator according to claim 1, in which said washer-shaped electrode means consists of only one washer-shaped electrode per cell and has a central hole through which accelerated charged particles pass and a periphery which is rounded.

5. In an accelerator for accelerating charged particles by using microwave energy, including a cylinder made of an electrically good conductor;

a plurality of washer-shaped electrodes disposed within said cylinder so as to be coaxial therewith;

stems securing said washer-shaped electrodes to said cylinder; and disks disposed on the inner surface of said cylinder;

said washer-shaped electrodes and said disks being disposed periodically and alternately along the axis of said cylinder, wherein the principal surface of said washer-shaped electrodes has no protrusions, but it is flat.

6. An accelerator according to claim 5, in which the thickness and the diameter of each of said washer-shaped electrodes and the gap between said washer-shaped electrodes and the inner surface of said cylinder are so chosen that the average strength of the accelerating electric field is highest.

* * * * *